US007826754B2

(12) United States Patent
Kurita et al.

(10) Patent No.: US 7,826,754 B2
(45) Date of Patent: Nov. 2, 2010

(54) IMAGE FORMING APPARATUS WITH THICKNESS DETECTING UNIT AND PARAMETER SETTING UNIT

(75) Inventors: Tomokazu Kurita, Kanagawa (JP); Kanji Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1114 days.

(21) Appl. No.: 11/504,044

(22) Filed: Aug. 15, 2006

(65) Prior Publication Data

US 2007/0140714 A1 Jun. 21, 2007

(30) Foreign Application Priority Data

Dec. 21, 2005 (JP) ..... P2005-367922
Dec. 21, 2005 (JP) ..... P2005-367923

(51) Int. Cl.
*G03G 15/00* (2006.01)

(52) U.S. Cl. ..... 399/26; 399/44; 399/50; 399/55

(58) Field of Classification Search ..... 399/26, 399/50, 55, 44
See application file for complete search history.

(56) References Cited

U.S. PATENT DOCUMENTS 6,421,508 B2 * 7/2002 Inoue et al. ..... 399/44

FOREIGN PATENT DOCUMENTS

JP 08334956 A * 12/1996
JP 2001-159838 6/2001
JP 2004-334063 A 11/2004

OTHER PUBLICATIONS

Machine Translation JP 08-334956.*

* cited by examiner

*Primary Examiner*—David P Porta
*Assistant Examiner*—Bryan P Ready
(74) *Attorney, Agent, or Firm*—Morgan, Lewis & Bockius LLP

(57) ABSTRACT

An image forming apparatus includes a photosensitive member, a charging device, a developing device, a thickness detecting unit and a parameter setting unit. A photosensitive layer is formed on a surface of the photosensitive member. The charging device charges the photosensitive member. The developing device forms a toner image on the surface of the photosensitive member. The thickness detecting unit detects a thickness of the photosensitive layer on a basis of a value of a current supplied to the charging device. When the thickness detecting unit detects the thickness of the photosensitive layer, the parameter setting unit sets at least one of a charge parameter for the charging device and a development parameter to be different from that used in forming an image on a recording medium by transferring a toner image formed on the surface of the photosensitive member onto the recording medium.

9 Claims, 5 Drawing Sheets

IN THICKNESS DETECTING OPERATION

IN IMAGE FORMING OPERATION

THICKNESS DETECTING OPERATION
IMAGE FORMING OPERATION
ONE CYCLE OF ROTATION OF PHOTOSENSITIVE MEMBER

NORMAL
CHARGE
DEVELOP
DISCHARGE

DECREASE CHARGE AMOUNT
CHARGE
DEVELOP
A
A

INCREASE DEVELOPING BIAS
CHARGE
DEVELOP
B
B

FORM BAND BY EXPOSURE
CHARGE
DEVELOP
EXPOSE
C
C

FORM BAND BY DEVELOPING BIAS
CHARGE
DEVELOP
D
D

FIG. 5
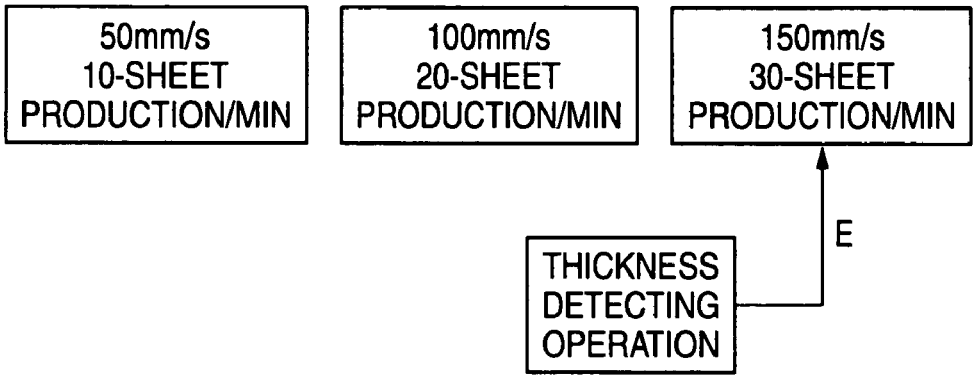
FIG. 6A
FIG. 6B
FIG. 6C
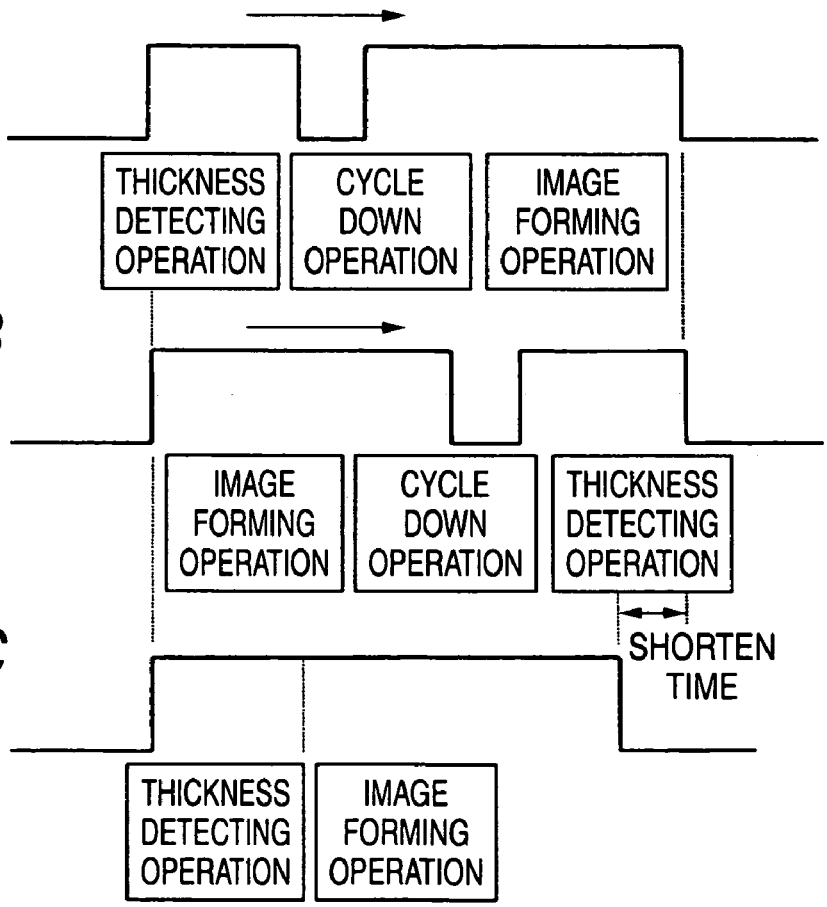

IMAGE FORMING APPARATUS WITH THICKNESS DETECTING UNIT AND PARAMETER SETTING UNIT

BACKGROUND

1. Technical Field

The invention relates to an image forming apparatus of an electrophotographic type, and more particularly to an image forming apparatus, which has a function of detecting the thickness of a photosensitive member.

2. Related Art

Recently, an image forming apparatus of the electrophotographic type is in widespread use. In the electrophotographic system, after a charging device charges a photosensitive member, a writing light source is caused to emit light to form an electrostatic latent image on the photosensitive member (exposure), a developing device visualizes the electrostatic latent image by means of a toner, the visible image is transferred from the photosensitive member onto a recording medium such as a printing sheet, and the recording medium is then discharged.

SUMMARY

According to an aspect of the invention, an image forming apparatus includes a photosensitive member, a charging device, a developing device, a thickness detecting unit and a parameter setting unit. A photosensitive layer is formed on a surface of the photosensitive member. The charging device charges the photosensitive member. The developing device forms a toner image on the surface of the photosensitive member. The thickness detecting unit detects a thickness of the photosensitive layer on a basis of a value of a current supplied to the charging device. When the thickness detecting unit detects the thickness of the photosensitive layer, the parameter setting unit sets at least one of a charge parameter for the charging device and a development parameter to be different from that used in forming an image on a recording medium by transferring a toner image formed on the surface of the photosensitive member onto the recording medium.

BRIEF DESCRIPTION OF THE DRAWINGS

Exemplary embodiments of the invention will be described in detail based on the following figures, wherein:

FIG. 2 is a view illustrating specific examples of a processing operation of the image forming apparatus according to a first exemplary embodiment of the invention.

FIG. 3 is a view illustrating specific examples of a charge parameter, which the image forming apparatus according to the first exemplary embodiment sets.

FIG. 5 is a view illustrating a specific example of a processing operation of an image forming apparatus according to still another exemplary embodiment of the invention; and FIG. 6 is a view illustrating a specific example of a processing operation of an image forming apparatus according to further another exemplary embodiment of the invention.

DETAILED DESCRIPTION

Hereinafter, an image forming apparatus according to exemplary embodiments of the invention will be described with reference to the accompanying drawings. The described image forming apparatus is of the electrophotographic type, which is useful in a copier, a printer apparatus, a facsimile apparatus, etc.

First, a specific configuration of the image forming apparatus according to this exemplary embodiment of the invention will be described.

Figure 1:
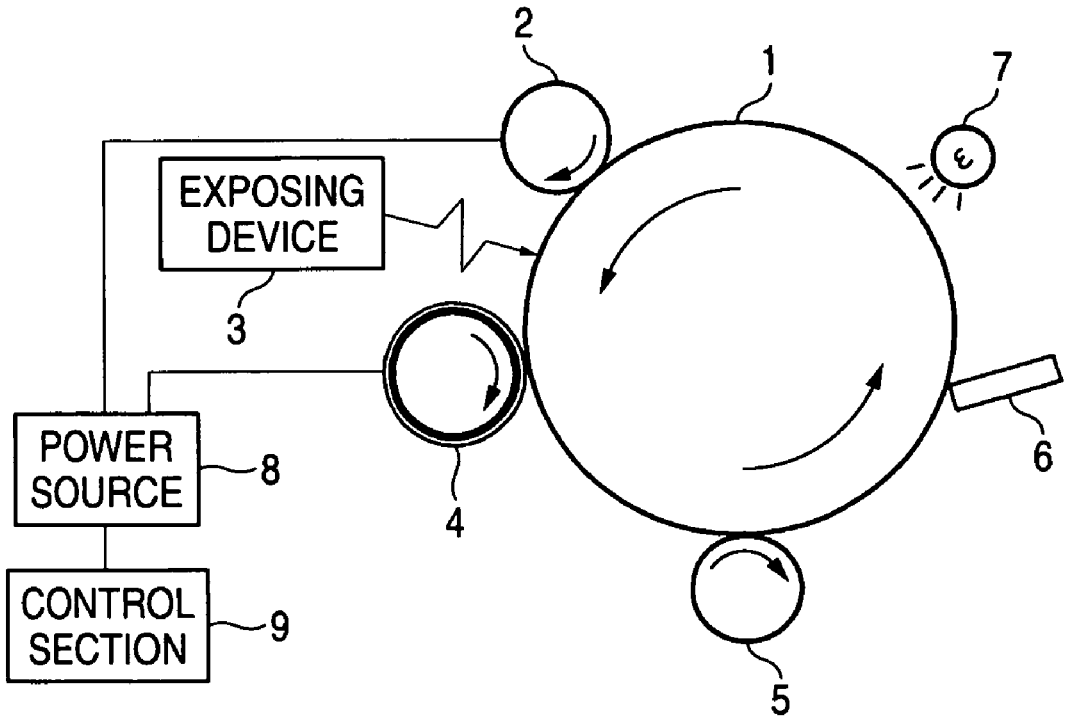
FIG. 1 is a diagram showing a schematic configuration of an image forming apparatus according to exemplary embodiments of the invention.

FIG. 1 is a diagram showing an example of a schematic configuration of the image forming apparatus of the invention. As shown in the example, the image forming apparatus of the electrophotographic type includes a photosensitive member 1, a charging device 2, an exposing device 3, a developing device 4, a transferring device 5, a cleaning member 6, a discharging device 7, a power source 8, and a control section 9.

The photosensitive member 1 may function as an image carrier. For example, the photosensitive member 1 has a shape of a drum, which is rotated at a predetermined peripheral speed. On the surface of the photosensitive member 1 (on its circumference surface), a photosensitive layer (not shown) is formed so as to function as an image carrier.

The charging device 2 charges the photosensitive member 1. For example, a device of the roller type may be used, which is in contact with the photosensitive member 1 to uniformly charge (for example, negatively charge) the surface with a predetermined polarity and potential.

The exposing device 3 irradiates (scan-exposes) the surface of the photosensitive member 1, which has been charged by the charging device 2, with a laser beam modulated with an image, to thereby form an electrostatic latent image on the surface of the photosensitive member 1.

The developing device 4 supplies a toner to the surface of the photosensitive member 1 to develop the electrostatic latent image formed on the surface of the photosensitive member 1, to thereby form a toner image, which is a visible image.

The transferring device 5 transfers the toner image formed on the surface of the photosensitive member 1, from the photosensitive member 1 onto a recording medium such as a printing sheet.

The cleaning member 6 is a blade-like (plate-like) member, which is in sliding friction with the surface of the photosensitive member 1 to remove residue (residual toner and adhesive contaminants) on the surface of the member after the transferring device 5 transfers the toner image, so as to prepare for the next image formation.

The discharging device 7 conducts discharge-exposure on the surface of the photosensitive member 1 to erase the electrostatic latent image formed on the surface.

The power source 8 supplies an electric power as required to the above-described components, particularly to the charging device 2 and the developing device 4. Among the components, in order to charge the photosensitive member 1, the power source 8 supplies to the charging device 2 a voltage in which an AC voltage and a DC voltage are superimposed with each other. The power source 8 supplies a bias voltage to the developing device 4 in order to supply the toner to the photosensitive member 1.

The control section 9 controls the operations of the above-described components 1 to 8. The operation controls performed by the control section 9 include a control on the power supply conducted by the power source 8. Namely, the control section 9 gives to the power source 8 operation instructions relating to the power supply conducted by the power source 8, sets parameters such as voltages and currents in operations, and monitors the power supply conducted by the power source 8. As a result of the operation control, the control section 9 can detect the thickness of the photosensitive layer of the photosensitive member 1 as described later. The power supply control (setting of the parameters, and the like) and the monitoring, which are performed by the control section 9, can be realized by known techniques in the same manner as the conventional art, and therefore their detailed description will be omitted.

First Exemplary Embodiment

Next, an example of the processing operation of the thus configured image forming apparatus will be described.

FIG. 2 is a view illustrating specific examples of the processing operation of the image forming apparatus according to this exemplary embodiment of the invention.

The processing operation performed by the image forming apparatus includes the image forming operation of transferring the toner image formed on the surface of the photosensitive member 1 onto a recording medium, and the thickness detecting operation of detecting the thickness of the photosensitive layer of the photosensitive member 1.

The image forming operation is a processing operation, which is performed in response to a job issued by a user's operation, or a job issued by instructions from a superior apparatus.

Also, the thickness detecting operation is a processing operation, which is performed at a predetermined timing such as at the time of activating the image forming apparatus or a timing before the image forming operation is started.

In the image forming operation, the charging device 2 charges the photosensitive member 1 with charges of a given polarity. The exposing device 3 scan-exposes the surface of the photosensitive member 1, which has been charged, to thereby form an electrostatic latent image on the surface of the photosensitive member 1. This electrostatic latent image is visualized by the developing device 4 to be a toner image. At this time, using a potential difference between the developing device 4 and the surface of the photosensitive member 1, which is generated by supply of the bias voltage from the power source 8, the developing device 4 supplies toner to the surface of the photosensitive member 1 to thereby visualize the electrostatic latent image. After the toner image is formed by developing the electrostatic latent image, the transferring device 5 applies charges of the same polarity as that of the electrostatic latent image while the recording medium is in contact with the surface of the photosensitive member 1, whereby the toner image on the surface of the photosensitive member 1 is transferred onto the recording medium. As a result, a visible image is formed on the recording medium, and then the recording medium is discharged. Thereafter, the cleaning member 6 removes a residual toner and adhesive contaminants, which remain on the surface of the photosensitive member 1. The discharging device 7 exposes the whole surface of the photosensitive member 1 to remove residual charges, to thereby prepare for the next image forming operation.

Figure 2A:
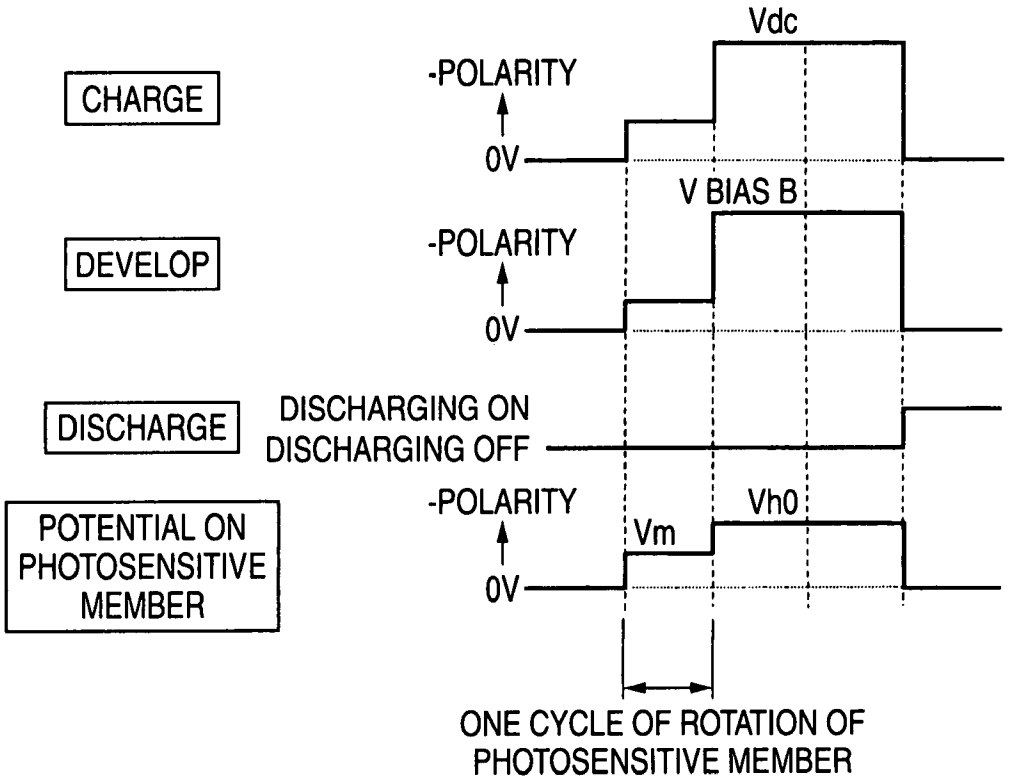
FIG. 2A is a view illustrating a processing operation when detecting a thickness of a photosensitive layer.
Figure 2B:
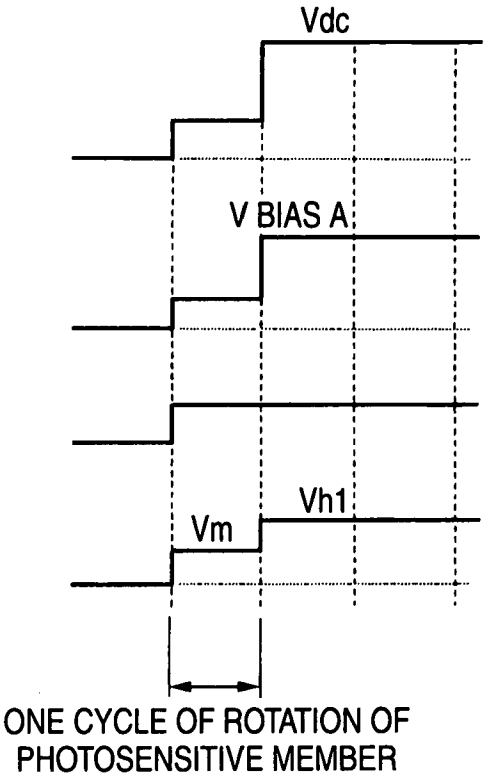
FIG. 2B is view illustrating a processing operation when forming an image.

At this time, as shown in FIG. 2B, in order to charge the photosensitive member 1, the charging device 2 applies DC voltage $_{Vdc}$ in a ragen of about −400V to about −1,000 V (e.g., about −700 V) to the photosensitive member 1. Also, at this time, a bias voltage $V_{Bias\ A}$ is, for example, about −580V. Accordingly, in the image forming operation, that is, potential $V_{h1}$ at the surface of the photosensitive member 1, which has been discharged by the discharging device 7 and then charged, is, for example, about −700V, and the potential difference $|V_{h1}-V_{BiasA}|$ between the surface of the photosensitive member 1 and the developing device 4 is, for example, about 120V. The reason why a voltage smaller than the DC voltage $V_{dc}$ is applied (a period corresponding to $V_m$ in FIG. 2) in the beginning of charging (first rotation of the photosensitive member 1) is that the photosensitive member 1 is surely charged by applying voltages stepwise. The same goes for the bias voltage of the developing device 4. Accordingly, in the case where certainty of the charging can be ensured from the beginning of the operation, it is not necessary to apply voltages stepwise.

On the other hand, in the thickness detecting operation, in the same manner as the above-mentioned image forming operation, the charging device 2 charges the photosensitive member 1 with charges of a given polarity. This charging is performed until the potential of the surface of the photosensitive member 1 is saturated. If required, therefore, the photosensitive member 1 is charged over plural rotations while the discharging device 7 is not operated or the photosensitive member is not discharged each rotation. When the charging device 2 has charged the photosensitive member 1, the control section 9 monitors (detects and measures) an integration value of the current, which is supplied from the power source 8 to the charging device 2 during the charging. That is, at this time, the control section 9 monitors change in the current value supplied by the power source 8, and integrates the monitored current value, and thereby calculates the amount of charges accumulated in the photosensitive member 1. This allows the thickness of the photosensitive layer of the photosensitive member 1 to be detected. The thickness of the photosensitive layer has a unique relationship with the amount of charges accumulated in the charging. If information relating to the correspondence relationship is previously specified, the thickness of the photosensitive layer can be detected by measuring the integration value of the current flowing when the photosensitive layer is charged.

In order to correctly detect the thickness of the photosensitive layer, it is required to correctly measure the amount of charges, which can be accumulated in the photosensitive member 1. Therefore, it is preferable to measure the amount of charges after the photosensitive member 1 is rotated plural times.

There is a certain degree of correlation between the thickness of the photosensitive layer and the current flowing through the charging device 2. Therefore, in a simpler thickness detecting method, the thickness of the photosensitive layer may be estimated on the basis of the value of the current flowing through the charging device 2.

By the way, in the case where the operation of detecting the thickness of the photosensitive layer is performed, BCO (beads carry over) may occur. Specifically, BCO may occur due to the following reasons. When the thickness detecting operation is performed, the discharging device 7 is not operated during the thickness detecting operation in order to charge the photosensitive layer of the photosensitive member 1 up to the saturation potential. As a result, dark decay in the photosensitive member 1 less occurs in comparison with the image forming operation, so that the charge potential of the photosensitive member 1 becomes larger than that in the image forming operation as described above. Specifically, the potential $V_{h0}$ on the surface of the photosensitive member 1 is larger than that in the image forming operation by about 50V. Therefore, if the thickness detecting operation is performed under the same conditions as that for the image forming operation, the potential difference between the developing device 4 and the surface of the photosensitive member 1 increases as the charge potential of the photosensitive member 1 increases, so that BCO occurs easily.

The image forming apparatus according to this exemplary embodiment performs the following processing operation when performing the thickness detecting operation. That is, when performing the thickness detecting operation, the control section 9 sets parameters regarding processing conditions to be different from those used in the image forming operation. Examples of the processing conditions may include a charge parameter for the charging device 2 (a parameter for specifying the charge voltage by the charging device) and a development parameter for the developing device 4 (a parameter for specifying a bias voltage of the developing device 4). The control section 9 may set one of these parameters to be different from that used in the image forming operation, or may set a plurality of parameters to be different from those used in the image forming operation. That is, the control section 9 may function as a controller, which sets at least one of the charge parameter and the development parameter to be different from that used in the image forming operation.

Here, the parameter setting by the control section 9 will be described with the case of setting the development parameter being taken as an example.

For example, in the case of setting the bias voltage $V_{Bias\ B}$ applied to the developing device 4 as the development parameter for the developing device 4, when performing the thickness detecting operation, the control section 9 sets a value of the bias voltage $V_{Bias\ B}$ so as to provide a period in which the value of the bias voltage $V_{Bias\ B}$ is larger than a value of the bias voltage $V_{Bias}$ A used in the image forming operation as shown in FIG. 2A. Specifically, if the setting value of the bias voltage $V_{Bias}$ A in the image forming operation is, for example, about −580V, the control section 9 sets the setting value of the bias voltage $V_{Bias\ B}$ in the thickness detecting operation to be larger by about 50V with considering the potential difference on the surface of the photosensitive member 1 ($V_{h0}$-$V_{h1}$). This setting may be applied to the entire period of the thickness detecting operation or a part of the period of the thickness detecting operation so long as there is a period in which $V_{Bias\ B}$ is larger than $V_{Bias\ A}$. Accordingly, even in the thickness detecting operation, voltages may be applied stepwise at its beginning as in the image forming operation (the period corresponding to $V_m$ shown in FIG. 2B).

The bias $V_{Bias\ B}$ may be determined on the basis of the potential of the surface of the photosensitive member 1, which has been charged by the charging device 2, more specifically, the potential difference between the potential of the surface of the photosensitive member 1 in the image forming operation and that is the thickness detecting operation, which is caused by presence/absence of the operation of the discharging device 7. The potential of the surface of the photosensitive member 1 (potential difference between the potential of the surface of the photosensitive member 1 in the image forming operation and that is the thickness detecting operation) may be specified using empirical rules obtained by experiments or simulations. That is, the value of the bias voltage $V_{Bias\ B}$ is determined based on the empirical rule in advance, and the control section 9 gives operation commands to the power source 8 and the developing device 4 by using such a value (fixed value).

it is noted that the potential of the surface of the photosensitive member 1 may be detected based on a monitoring result of power supply to the charging device 2. That is, if the power supply performed by the power source 8 is monitored, the control section 9 can detect the potential of the surface of the photosensitive member 1 in real time based on the monitoring result. Therefore, in the case where the control section 9 can detect the potential of the surface of the photosensitive member 1, the control section 9 may change the setting value of the bias voltage $V_{Bias\ B}$ in accordance with the detection result. Specifically, the control section 9 may change the setting initial value of the bias voltage $V_{Bias\ B}$ in accordance with the detection result of the potential of the surface of the photosensitive member 1. Also, for example, a relation expression obtained from empirical rule may be set in advance, and the control section 9 calculates the setting value of the bias voltage $V_{Bias\ A}$ based on the detection result of the potential of the surface of the photosensitive member 1 while using the relational expression. That is, the control section 9 may function as a monitoring unit that monitors the potential of the surface of the photosensitive member 1 and specifies the setting value of the bias voltage $V_{Bias\ B}$ in accordance with the monitoring result.

When the control section 9 sets such a development parameter, the control section 9 instructs the power source 8 to supply voltage in accordance with the settings. In accordance with this instruction, the power source 8 supplies the bias voltage to the developing device 4. Therefore, in the thickness detecting operation, the bias voltage $V_{Bias\ B}$ of the developing device 4 becomes about −630V, which is has the same polarity as the bias voltage $V_{Bias\ A}$ and is larger than the bias voltage $V_{Bias\ A}$ of about −580V by about 50V. A relation between the potential of the surface of the photosensitive member 1 and the setting value of the bias voltage $V_{Bias\ B}$ may satisfy $a-c \leqq b-d$ where "a" represents the potential of the surface of the photosensitive member 1 to be monitored in the thickness detecting operation, "b" represents the potential of the surface of the photosensitive member 1 in the image forming operation, which is a fixed value, "c" represents the setting value of the bias voltage $V_{Bias\ B}$ and "d" represents the setting value of the bias voltage $V_{Bias\ A}$.

In the above description, the case where the development parameter is set is taken as an example of the parameter settings by the control section. Even in the case where not the development parameter but the charge parameter is set to be different from that in the image forming operation or in the case where both of the development parameter and the charge parameter are set to be different from those in the image forming apparatus, occurrence of BCO can be prevented by suppressing the potential difference between the photosensitive member 1 and the developing device 4 from increasing.

Next, settings of the charge parameter will be described in detail with reference to specific examples.

Figure 3B:
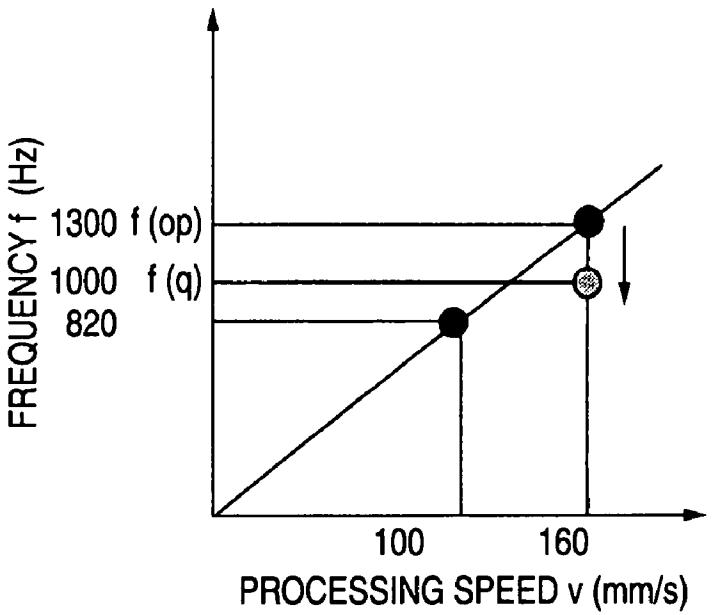
FIG. 3A is a view illustrating an example of a set value of an applied current and FIG. 3B is a view illustrating an example of a set value of an AC frequency.

FIG. 3 is a view illustrating specific examples of the charge parameter.

Generally, in the case of performing the thickness detecting operation, it is necessary to apply a constant voltage $V_{dc}$ and flow a current $I_{ac}$, which can keep a constant potential, under any condition for the purpose of accurate measurement of a charge amount (measurement of an integration value of the current). To ensure this, the same settings as that in the image forming operation may be adopted. Therefore, as described above, in the case where it is attempted to prevent BCO from occurring by means of setting the development parameter, the charge parameter may be set to be the same settings as that used in the image forming operation.

Here, settings of the current in the image forming operation will be described.

Figure 3A:
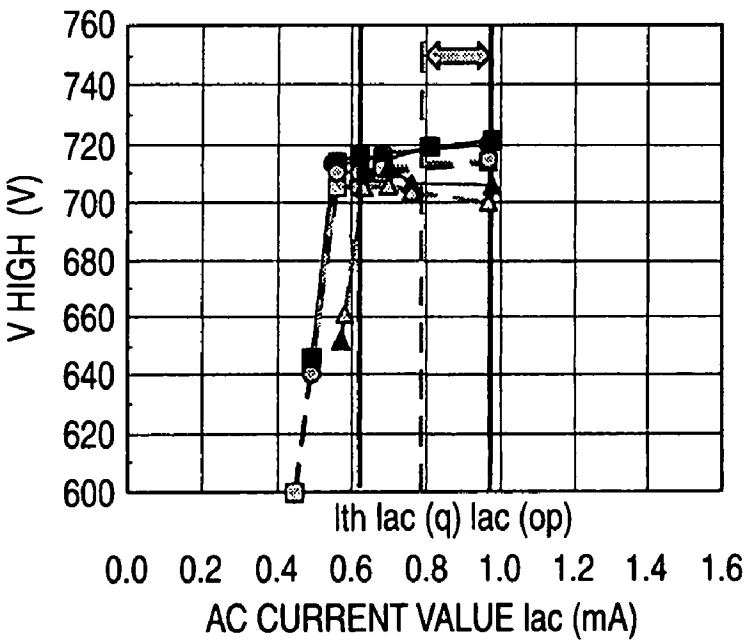

As shown in FIG. 3A, in the AC+DC superimposing system, a charge potential $V_h$ is increased as an AC current value $I_{ac}$ is increased. However, when the AC current value is equal to or larger than a current value $I_{th}$, the charge potential $V_h$ is getting to be constant so as to converge with a potential around the set value of the voltage $V_{dc}$. The current value $I_{th}$ (hereinafter, referred to as a "current inflection point" on the curve of the AC current value $I_{ac}$ flowing through the charging device versus the charge potential $V_h$ of the surface of the photosensitive layer) is, for example, equal to about 0.6 mA.

The current inflection point $I_{th}$ varies to some extent due to the use environment (e.g., an ambient temperature of the image forming apparatus) of the image forming apparatus and the thickness of the photosensitive layer. Also, the charge potential $V_h$ around the current inflection point $I_{th}$ is not stable, and easily causes charge defection, which is apt to result in a partial defection of an image quality.

Therefore, generally, the AC current $I_{ac}$ in the image forming operation is often set to be a value $I_{ac(op)}$, which is larger enough than the current inflection point $I_{th}$. Specifically, for example, the AC current $I_{ac}$ in the image forming operation may be set to be about 1.0 mA so as to ensure enough safety margin.

However, in the thickness detecting operation, if the surface of the photosensitive member 1 has a stable charge potential, the thickness of the photosensitive layer can be measured without trouble even with defect of an image quality to some extent.

Also, it is possible to prevent BCO from occurring in the thickness detecting operation by setting the charge parameter separately from the development parameter or setting the charge parameter in combination with the development parameter so as to be different from that used in the image forming operation. That is, if the charge potential $V_h$ on the surface of the photosensitive member 1 is smaller than that in the image forming operation, the potential difference between the surface of the photosensitive member 1 and the developing device 4 is suppressed. As a result, it is possible to prevent BCO from occurring.

Accordingly, when performing the thickness detecting operation, the control section 9 may set the charge parameter for the charging device 2 as follows. That is, in the case where the control section 9 sets an applied current, which is used when the charging device 2 charges, as a charge parameter for the charging device, the control section 9 sets the value $I_{ac(q)}$ of the applied current so as to be smaller than the current set value $I_{ac(op)}$ used in the image forming operation and so as to be larger than the current inflection point $I_{th}$ after which the potential of the surface of the photosensitive layer converges. Specifically, the control section 9 sets $I_{ac(q)}$ to be equal to about 0.8 mA, which is larger than the current inflection point $I_{th}$=0.6 mA and is smaller than the current set value $I_{ac(op)}$ =1.0 mA, which is used in the image forming operation.

At this time, the settings of the charge parameter satisfy the relation "$I_{ac(op)}>I_{ac(q)}>I_{th}$." When this relation expression is divided by $I_{th}$, we can obtain "$I_{ac(op)}/I_{th}>I_{ac(q)}/I_{th}>1$." Therefore, according to the settings of the charge parameter described above, if a margin amount used in the image forming operation is expressed as "$M_{(op)=Iac(op)}/I_{th}$" and a margin amount used in the thickness detecting operation is expressed as "$M_{(q)=Iac(q)}/I_{th}$," the margin amount from the current inflection point $I_{th}$ satisfies "$M_{(op)}>M_{(q)}>1$."

Also, as a charge parameter used in the AC+DC superimposing system, settings of an AC frequency may be used as well as the settings of the applied current.

Normally, the AC frequency may be set to be a frequency $f_{(op)}$, which is in substantially proportion to the processing speed (a driving speed of the photosensitive member 1). However, it has been known if the AC frequency is decreased, $I_{ac(op)}$ and $I_{th}$ are decreased in proportion thereto.

Therefore, when the AC frequency is set to be smaller than that used in the image forming operation, energy given to the photosensitive member 1 during the thickness detecting operation can be suppressed to be small, so that the damage of the photosensitive member 1 can be reduced.

Accordingly, in the case where the control section 9 sets the AC frequency, which is used when the charging device 2 charges, as a charge parameter for the charging device 2, the control section 9 may set a value $f_{(q)}$ of the AC frequency so as to be smaller than a value $f_{(op)}$ of the AC frequency used in the image forming operation. Specifically, for example, in the case where the processing speed is 160 mm/sec, the control section 9 may set $f_{(q)}$ of the AC frequency used in the thickness detecting operation=about 1,000 Hz, which is smaller than $f_{(op)}$ of the AC frequency used in the image forming operation=1,300 Hz. That is, at this time, the settings of the charge parameter satisfy the relation "$f_{(op)}>f_{(q)}$."

As settings of the charge parameter in the thickness detecting operation, only the applied current may be set, only the AC frequency may be set or both of them may be set. In any of these cases, it is possible to prevent BCO from occurring.

It is noted that of references used in setting of the charge parameter, there are references, which vary in accordance with the use environment of the image forming apparatus (e.g., the ambient temperature of the image forming apparatus) and the thickness of the photosensitive layer, such as the current inflection point $I_{th}$. Therefore, for the purpose of dealing with such a variation flexibly and appropriately, when the charge parameter is set, at least one of the applied current, the applied voltage and the AC frequency, which are used when the charging device 2 charges, may be changed in accordance with the thickness detecting result obtained in the thickness detection operation, which has already been done, or the monitoring result of the use environment of the image forming apparatus. For example, variation of the use environment of the image forming apparatus such as temperature and humidity has a unique relation with variation of a current value required to charge at a desired potential. Therefore, when the correspondence relation is specified in advance, even if the use environment of the image forming apparatus varies, an appropriate charge parameter can be set. In that case, the use environment of the image forming apparatus may be monitored by means of a known technique such as a temperature sensor and a humidity sensor. Also, if the image forming apparatus has a function of dealing with such a variation occurring in the image forming operation, the image forming apparatus may deal with such a variation occurring in the thickness detecting operation. Even in that case, the charge parameter used in the thickness detecting operation is set to be different from that used in the image forming operation.

Second Exemplary Embodiment

Next, the processing operation of an image forming apparatus according to a second exemplary embodiment will be described. Similar parts are assigned to similar reference numerals to those used in the first exemplary embodiment.

FIG. 4 is a view illustrating specific examples of the processing operation of the image forming apparatus according to this exemplary embodiment of the invention.

In the image forming operation, the charging device 2 charges the photosensitive member 1 with charges of a given polarity. The exposing device 3 scan-exposes the surface of the photosensitive member 1, which has been charged, to thereby form an electrostatic latent image on the surface of the photosensitive member 1. At this time, in order to charge the photosensitive member 1, the charging device 2 applies a DC voltage of about −400 to −1,000 V, specifically, −700 V, to the photosensitive member 1. Also, the bias voltage of the developing device 4 is, for example, about −580 V. Therefore, the potential of the surface of the photosensitive member 1 is, for example, about −700 V, and the potential difference between the surface and the developing device 4 is, for example, about 120 V. Using the potential difference, the developing device 4 supplies the toner to the surface of the photosensitive member 1, to thereby develop the electrostatic latent image.

After the toner image is formed by developing the electrostatic latent image, the transferring device 5 applies charges of the same polarity as that of the electrostatic latent image while the recording medium is in contact with the surface of the photosensitive member 1, whereby the toner image on the surface of the photosensitive member 1 is transferred onto the recording medium. As a result, a visible image is formed on the recording medium, and then the recording medium is discharged. Thereafter, the cleaning member 6 removes a residual toner and adhesive contaminants, which remain on the surface of the photosensitive member 1. The discharging device 7 exposes the whole surface of the photosensitive member 1 to remove residual charges, to thereby prepare for the next image forming operation.

By contrast, the thickness detecting operation is a processing operation, which is performed at a predetermined timing, which is previously set. For example, the predetermined timing is a timing at which the image forming apparatus is activated or a timing before the image forming operation is started. Conditions for starting the thickness detecting operation may include a condition that number of rotations of the photosensitive member reaches a predetermined number and/or a condition that number of the image forming operations reaches a predetermined number.

In the thickness detecting operation, in the same manner as the above-mentioned image forming operation, the charging device 2 charges the photosensitive member 1 with charges of a given polarity. This charging is performed until the potential of the surface of the photosensitive member 1 is saturated. If required, therefore, the photosensitive member 1 is charged over plural rotations while the discharging device 7 is not operated or the photosensitive member is not discharged each rotation. When the charging device 2 has charged the photosensitive member 1, the control section 9 monitors (detects and measures) an integration value of the current, which is supplied from the power source 8 to the charging device 2 during the charging. This allows the thickness of the photosensitive layer of the photosensitive member 1 to be detected. The thickness of the photosensitive layer has a unique relationship with the amount of charges accumulated in the charging. If information relating to the correspondence relationship is previously specified, the thickness of the photosensitive layer can be detected by measuring the integration value of the current flowing when the photosensitive layer is charged.

In the initial stage of the charging of the photosensitive member 1 by the charging device 2, stepwise application of the voltage may be performed. That is, in the first rotation of the photosensitive member 1, a voltage lower than the predetermined DC application voltage (for example, −700 V) may be applied. This is because when the voltage is stepwisely applied, the photosensitive member 1 can be surely charged. This is applicable also to the bias voltage of the developing device 4. In the case where certainty of the charging can be ensured in the initial stage of the charging, however, it is not necessary to apply the voltage stepwise.

The thickness detecting operation and the image forming operation will be described in further detail based on the following example. In this example, the predetermined timing at which the thickness detecting operation is performed is prior to start of the image formation operation. That is, after the thickness detecting operation is performed, the image formation operation is performed subsequently.

Figures 4A, 4B, 4C, 4D, 4E:
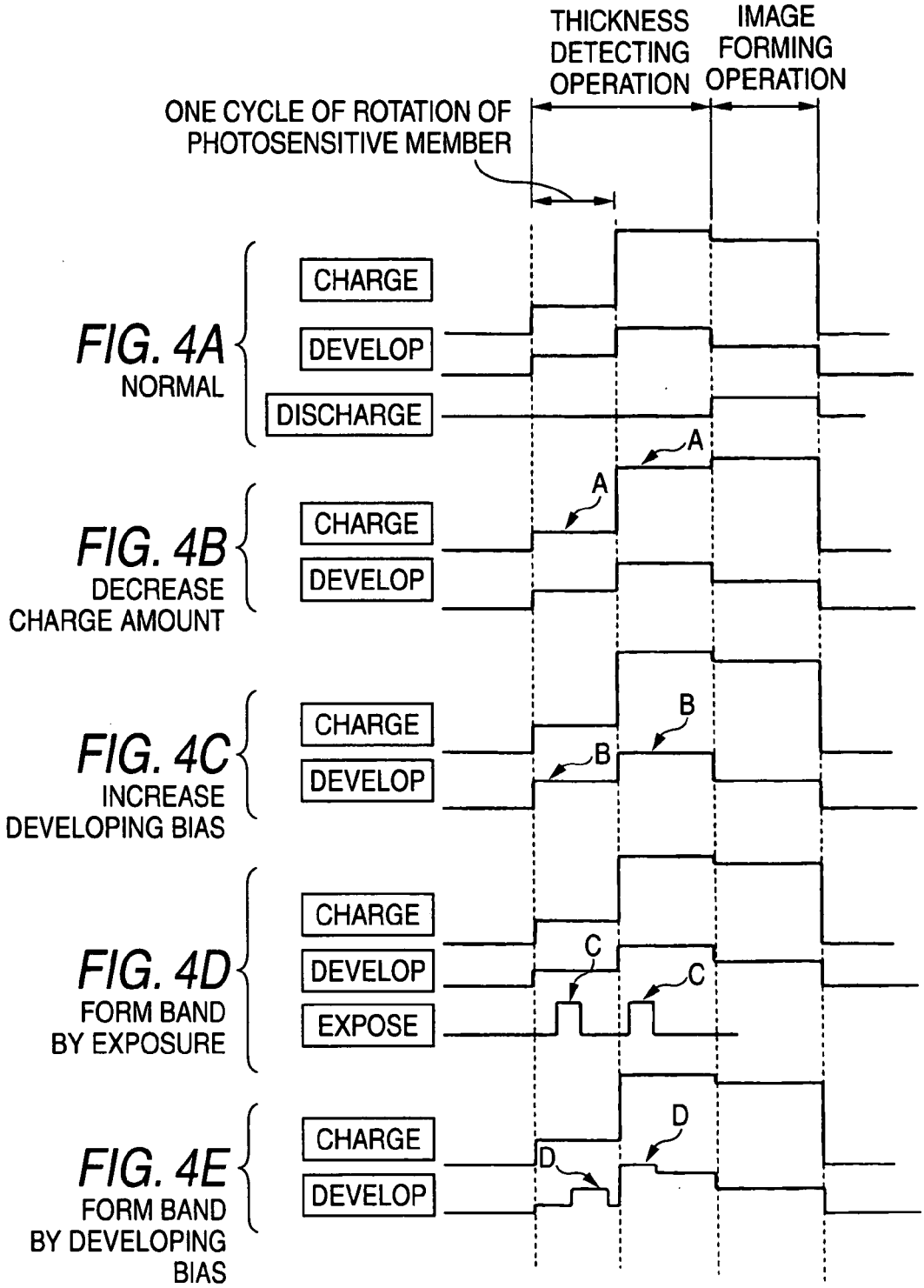
FIG. 4 is a view illustrating specific examples of a processing operation of the image forming apparatus according to a second exemplary embodiment of the invention.

When a job issued by the user's operation or a job issued by instructions from the superior apparatus, the image forming apparatus first performs the thickness detecting operation prior to the image forming operation. That is, as shown in FIG. 4A, the control section 9 controls the charging device 2 so as to apply voltages stepwise onto the photosensitive member 1. The control section 9 controls the bias voltage of the developing device 4 similarly. However, the discharging device 7 is not operated. At this time, the control section 9 monitors change in the current value supplied by the power source 8, and integrates the monitored current value, and thereby calculates the amount of charges accumulated in the photosensitive member 1. The control section 9 detects the thickness of the photosensitive layer of the photosensitive member 1 based on the calculated amount of charges. In order to correctly detect the thickness of the photosensitive layer, it is required to correctly measure the amount of charges, which can be accumulated in the photosensitive member 1. Therefore, it is preferable to measure the amount of charges after the photosensitive member 1 is rotated plural times.

There is a certain degree of correlation between the thickness of the photosensitive layer and the current flowing through the charging device 2. Therefore, in a simpler thickness detecting method, the thickness of the photosensitive layer may be estimated on the basis of the value of the current flowing through the charging device 2.

When the thickness of the photosensitive layer is detected in this way, the control section 9 determines based on a result of the detection whether the subsequent image forming operation can be executed or not. If the control section 9 has a parameter changing function, the control section 9 sets operation parameters (for example, the value of the DC application voltage) for the image forming operation in accordance with the result of the thickness detecting operation. Thereafter, the image forming operation is started. At this time, certainty of the charging can be sufficiently ensured because of the thickness detecting operation, which has been already done. Hence, it is not necessary to apply voltages stepwise.

In the case where the operation of detecting the thickness of the photosensitive layer is performed, the coefficient of friction between the surface of the photosensitive member 1 and the cleaning member 6 may increase. This phenomenon is caused because in the thickness detecting operation, unlike in the image forming operation, the photosensitive member 1 is rotated plural times for the purpose of the thickness detecting operation while a toner image is not formed on the surface of the photosensitive member 1 or the charged photosensitive member 1 is not discharged each rotation.

From the above, in the image forming apparatus according to this exemplary embodiment, when the thickness detecting operation is to be performed, the following processing operation is performed. Namely, a process of reducing the coefficient of friction between the surface of the photosensitive member 1 and the cleaning member 6 is performed.

In an example of the process of reducing the coefficient of friction, the developing device 4 supplies the toner to the surface of the photosensitive member 1 during a period in which no image is formed. When toner fogging occurs, the toner functions as a lubricant between the surface of the photosensitive member 1 and the cleaning member 6, so that the coefficient of friction therebetween can be reduced.

The toner is supplied to the surface of the photosensitive member 1 during the period in which no image is formed, for example, by utilizing the operation parameters, which are set by means of the control section 9 in the thickness detecting operation. Examples of the operation parameters, which are useful in this case, include a charge parameter of the charging device 2 (a parameter specifying the DC voltage applied by the charging device 2), and a development parameter of the developing device 4 (a parameter specifying the bias voltage of the developing device 4). Namely, the control section 9 sets one or both of the charge parameter of the charging device 2 and the development parameter of the developing device 4 so as to supply the toner to the photosensitive member 1 during the period in which no image is formed. In other words, the control section 9 functions as the friction reducing unit, which reduces the coefficient of friction between the surface of the photosensitive member 1 and the cleaning member 6, by means of setting at least one of the charge parameter and the development parameter.

Specifically, as shown in FIG. 4B, for example, the amount of charges (the DC application voltage) applied to the photosensitive member 1 by the charging device 2 is made smaller than that in the image forming operation (see "A" in FIG. 4B). If the amount of charges is made smaller, the potential difference between the photosensitive member 1 and the developing device 4 becomes small in the case where the potential of the photosensitive member 1 is identical in polarity with that of the toner in the developing device 4. As a result, the transfer (electrostatic attraction) of the toner from the developing device 4 to the photosensitive member 1 is promoted. Namely, the developing device 4 is caused to supply the toner to the surface of the photosensitive member 1, by reducing the amount of charges.

Furthermore, as shown in FIG. 4C, for example, the bias voltage applied to the developing device 4 is made higher than that in the image forming operation (see "B" in FIG. 4C). Also, if the bias voltage is made higher, in the same manner as the above-described case where the amount of charges is made smaller, the potential difference between the photosensitive member 1 and the developing device 4 becomes small in the case where the potential of the photosensitive member 1 is identical in polarity with that of the toner in the developing device 4. As a result, the transfer of the toner from the developing device 4 to the photosensitive member 1 is promoted. Namely, the developing device 4 is caused to supply the toner to the surface of the photosensitive member 1, by increasing the bias voltage.

When the toner is supplied to the photosensitive member 1 during the period in which no image is formed by reducing the potential difference between the photosensitive member 1 and the developing device 4, the supplied toner functions as a lubricant between the photosensitive member 1 and the cleaning member 6. As a result, the coefficient of friction therebetween can be reduced. In order that the supplied toner functions as a lubricant, the toner of 0.01 mg/cm$^2$, which is twice as large as the toner used in the normal image formation operation, or more may be supplied to the photosensitive member 1. The toner having such a quantity reduces the coefficient of friction between the photosensitive member 1 and the cleaning member 6 by 10% or more in comparison with the coefficient of friction therebetween during the normal image formation operation. It is assumed that when no toner exists between the photosensitive member 1 and a cleaning blade (cleaning member 6), a coefficient of friction therebetween is expressed as 100%. In this case, when the toner supplied during the period in which no image is formed functions as a lubricant, the coefficient of friction therebetween decreases by at least 10%.

In addition, when the potential difference is made smaller, it can be expected to suppress a phenomenon, which is called BCO (beads carry over) in which a carrier (a metal magnetic material) of a toner developer material is transferred to the photosensitive member 1 side.

In the case where the potential of the photosensitive member 1 is different in polarity from that of the toner in the developing device 4, contrary to the above-described case of the same polarity, the control section 9 is requested to set one or both of the charge parameter of the charging device 2 and the development parameter of the developing device 4 so that the potential difference between the photosensitive member 1 and the developing device 4 is increased. This promotes the transfer of the toner from the developing device 4 to the photosensitive member 1.

Alternatively, exposure by the exposing device 3 alone or in combination with the above-mentioned parameter setting can supply the toner to the photosensitive member 1. Namely, as shown in FIG. 4D, for example, the exposing device 3 scan-exposes the surface of the photosensitive member 1, which has been charged by the charging device 2 (see "C" in FIG. 4D), to form an electrostatic latent image on the surface of the photosensitive member 1. When the electrostatic latent image is formed in such a manner, the developing device 4 develops the electrostatic latent image. As a result, the same state as the case where the toner is supplied to the photosensitive member 1 during the period no image is formed is obtained.

At this time, the electrostatic latent image may be uniformly formed on the surface of the photosensitive member 1, or have a strip-like shape, which exists only in a specified place of the surface of the photosensitive member 1. This means that according to the above-mentioned parameter setting, the toner is supplied in a strip-like manner. This is because even if the toner is supplied in the strip-like shape, the toner still functions as a lubricant. In the case where the parameter setting supplies the toner in the stripe-shape manner, as shown in FIG. 4E, for example, the control section 9 sets the development parameter to apply voltages of plural steps to the developing device in a single rotation of the photosensitive member 1 (see "D" in FIG. 4E) Alternatively, the control section 9 may change the charge parameter to apply voltages of plural steps to the charging device 2 in the single rotation of the photosensitive member 1.

The above-mentioned processing operation of supplying the toner to the photosensitive member 1 during the period in which no image is formed may be performed during the thickness detecting operation. This is because the supplied toner can suppress the coefficient of friction between the surface of the photosensitive member 1 and the cleaning member 6 from increasing.

However, it is not necessary to supply the toner during the thickness detecting operation. If the toner is supplied to the photosensitive member 1 before the thickness detecting operation is started, so as to bring parts between the surface of the photosensitive member 1 and the cleaning member 6 to be in a so-called toner rich state, it is expected that the toner in the rich state functions as a lubricant between the surface of the photosensitive member 1 and the cleaning member 6 even after the thickness detecting operation is started. In the specification, "before the thickness detecting operation is started" means "before the control section 9 starts the monitoring operation for detecting the thickness (of the photosensitive layer)". In the case of applying the stepwise voltage in the initial stage of the charging of the photosensitive member 1, for example, if it is started to charge the photosensitive member 1 but the control section 9 has not yet started the monitoring operation, this corresponds to "before the thickness detecting operation is started".

In the second exemplary embodiment, the example in which the toner is supplied to the photosensitive member during the period in which no image is formed by the operation control executed by the control section 9 to reduce the coefficient of friction between the surface of the photosensitive member 1 and the cleaning member 6 has been described. Alternatively, the reduction in the coefficient of friction may be realized by another technique. As another technique, for example, the contact pressure of the cleaning member 6 against the surface of the photosensitive member 1 in the thickness detecting operation may be made smaller than that in the image forming operation. The contact pressure can be changed by a driving source such as an electromagnetic solenoid. Also such a change of the contact pressure can reduce the coefficient of friction between the surface of the photosensitive member 1 and the cleaning member 6. In this case, damages of the cleaning member 6 and abrasion of the photosensitive member 1 can also be suppressed by reducing the coefficient of friction. Namely, the friction reducing unit may be realized by a mechanism for changing the contact pressure of the cleaning member 6 against the surface of the photosensitive member 1. Alternatively, the friction reducing unit may be realized by a configuration, which has a function of applying a lubricating agent such as zinc stearate and increases application amount of the lubricating agent in the thickness detecting operation.

Next, another example of the processing operation of detecting the thickness of the photosensitive layer will be described.

FIGS. 5 and 6 are views illustrating another processing operation of the image forming apparatus according to another exemplary embodiment of the invention.

As described above, when the thickness detecting operation is to be performed, the photosensitive member 1 is rotated plural times. Namely, the thickness detecting operation takes time for rotating the photosensitive member 1 plural times. During the time to be spent for the thickness detecting operation, an image cannot be formed. Therefore, the time does not contribute to improvement in productivity of the image formation by the image forming apparatus. From this point, when the thickness detecting operation is to be performed, the control section 9 may set operation parameters in the following manner.

Generally, among image forming apparatuses, there is an image forming apparatus, which can select productivity of a job when the job is to be issued thereto. Specifically, as shown in FIG. 5, for example, the image forming apparatus can switch the productivity of the job between 10 sheets/minute and 20 sheets/minute, based on conditions of the image formation such as a type of the recording medium and color image formation/non-color image formation. The control section 9 sets the operation parameters in the image forming operation in such a manner that if 10 sheets/minute is selected, the peripheral rotational speed of the photosensitive member 1 is set to 50 mm/s, and that if 20 sheets/minute is selected, the peripheral rotational speed of the photosensitive member 1 is set to 100 mm/s. Therefore, also the operation parameters in the thickness detecting operation may be normally set to the same operation parameters as those in the image forming operation.

During the time required for the thickness detecting operation, however, the image cannot be formed as described above. Therefore, the control section 9 sets the operation parameters for the thickness detecting operation so that the slowest setting at which the photosensitive member 1 is operable is not employed. Specifically, even if either of 10 sheets/minute and 20 sheets/minute is selected as the productivity of the job, the control section 9 sets the operation parameters for the thickness detecting operation so that the peripheral rotational seed of the photosensitive member 1 is equal to 100 mm/s, which is higher peripheral rotational speed at which the photosensitive member 1 is operable.

If an image forming apparatus can switch the productivity among three or more kinds of speeds, it is preferable not to select the slowest speed. Furthermore, the control section 9 may set the operation parameters for the thickness detecting operation to the highest speed at which the photosensitive member 1 is operable (see "E" in FIG. 5). The terms "the highest speed at which the photosensitive member 1 is operable" mean not only a speed at which the photosensitive member 1 is operable, but also that when the photosensitive member 1 operates at such a speed, various components (the charging device 2, the developing device 4, etc.), which operate in association with the photosensitive member 1, are operable.

As described above, the timing at which the thickness detecting operation is performed may be before the image forming operation is performed. That is, the image forming operation may be performed after the thickness detecting operation is performed as shown in FIG. 6A. Contrary to the above, as shown in FIG. 6B, the thickness detecting operation may be performed after the image forming operation.

In either case, if a cycle down operation is performed between the respective operations, the productivity is lowered accordingly. Examples of the cycle down operation include an operation for performing a discharging operation by the discharging device 7 to restore the photosensitive member 1 to a non-charged state. Namely, the cycle down operation is an operation to be performed for restoring the state of the photosensitive member 1 between operations to its initial state. Examples of the cycle down operation also include an operation of reducing the rotational speeds of rotation members required for image formation (for example, the photosensitive member and a rotary polygon mirror of the exposing device).

In the case where the image forming operation is to performed subsequently to the thickness detecting operation, or in the case where the thickness detecting operation is to performed subsequently to the image forming operation, therefore, the control section 9 does not perform the cycle down operation between the respective operations and starts the subsequent image forming operation or thickness detecting operation as shown FIG. 6C.

Although the image forming apparatus of the exemplary embodiments has been described above, the invention is not limited thereto. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photosensitive member, a photosensitive layer formed on a surface of the photosensitive member;

a charging device that charges the photosensitive member;

a developing device that forms a toner image on the surface of the photosensitive member;

a thickness detecting unit that detects a thickness of the photosensitive layer on a basis of a value of a current supplied to the charging device; and a parameter setting unit, wherein when the thickness detecting unit detects the thickness of the photosensitive layer, the parameter setting unit sets at least one of a charge parameter for the charging device and a development parameter to be different from that used in forming an image on a recording medium by transferring a toner image formed on the surface of the photosensitive member onto the recording medium, wherein:

the parameter setting unit sets a bias voltage applied to the developing device as the development parameter for the developing device, and when the thickness detecting unit detects the thickness of the photosensitive layer, the parameter setting unit sets the development parameter so as to provide a period in which a value of a bias voltage is larger than that used in forming the image on the recording medium.

2. The apparatus according to claim 1, wherein the parameter setting unit sets the bias voltage on a basis of potential of the surface of the photosensitive layer after the charging device charges the photosensitive member.

3. The apparatus according to claim 2, further comprising:

a monitoring unit that monitors the potential of the surface of the photosensitive layer and notifies a monitored potential to the parameter setting unit.

4. An image forming apparatus comprising:

a photosensitive member, a photosensitive layer formed on a surface of the photosensitive member;

a charging device that charges the photosensitive member;

a developing device that forms a toner image on the surface of the photosensitive member;

a thickness detecting unit that detects a thickness of the photosensitive layer on a basis of a value of a current supplied to the charging device; and a parameter setting unit, wherein when the thickness detecting unit detects the thickness of the photosensitive layer, the parameter setting unit sets at least one of a charge parameter for the charging device and a development parameter for the developing device to be different from that used in forming an image on a recording medium by transferring a toner image formed on the surface of the photosensitive member onto the recording medium wherein:

the parameter setting unit sets a current, which the charging device applies when charging, as the charge parameter for the charging device, and when the thickness detecting unit detects the thickness of the photosensitive layer, the parameter setting unit sets a value of the applied current to be smaller than that used in forming the image on the recording medium and to be larger than a value of a current inflection point on a curve of an AC current value flowing through the charging device versus a potential of the surface of the photosensitive layer.

5. An image forming apparatus comprising:

a photosensitive member, a photosensitive layer formed on a surface of the photosensitive member;

a charging device that charges the photosensitive member;

a developing device that forms a toner image on the surface of the photosensitive member;

a thickness detecting unit that detects a thickness of the photosensitive layer on a basis of a value of a current supplied to the charging device; and a parameter setting unit, wherein when the thickness detecting unit detects the thickness of the photosensitive layer, the parameter setting unit sets at least one of a charge parameter for the charging device and a development parameter for the developing device to be different from that used in forming an image on a recording medium by transferring a toner image formed on the surface of the photosensitive member onto the recording medium wherein:

the parameter setting unit sets an AC frequency used when the charging device charges, as the charge parameter for the charging device, and when the thickness detecting unit detects the thickness of the photosensitive layer, the parameter setting unit sets a value of the AC frequency to be smaller than that used in forming the image on the recording medium.

6. The apparatus according to claim 4, further comprising:

a sensor that monitors an apparatus use environment including at least one of temperature and humidity, wherein:

the parameter setting unit changes the applied current used when the charging device charges, in accordance with at least one of the thickness of the photosensitive layer detected by the thickness detecting unit and a monitoring result by the sensor.

7. The apparatus according to claim 5, further comprising:

a sensor that monitors an apparatus use environment including at least one of temperature and humidity, wherein:

the parameter setting unit changes the AC frequency used when the charging device charges, in accordance with at least one of the thickness of the photosensitive layer detected by the thickness detecting unit and a monitoring result by the sensor.

8. The image forming apparatus according to claim 1, further comprising:

an operation controlling unit, when the thickness detecting unit is to detect the thickness of the photosensitive member, the operation controlling unit controlling an operation of the photosensitive member so as to operate at as high speed a as possible.

9. The apparatus according to claim 8, wherein, when an image forming operation of transferring a toner image onto a recording medium is performed after a thickness detecting operation performed by the thickness detecting unit or when the thickness detecting operation is performed after the image forming operation, the operation controlling unit starts the image forming operation or the thickness detecting operation to be subsequently performed without performing a cycle down operation between the operations.

* * * * *